US007171732B2

(12) United States Patent
Klas et al.

(10) Patent No.: US 7,171,732 B2
(45) Date of Patent: Feb. 6, 2007

(54) METHOD FOR COMPRESSIVE SHRINKING AND RUBBER BLANKET SHRINKING SYSTEM

(75) Inventors: Ernst Klas, Mönchengladbach (DE); Hans Hoppenstock, Möchengladbach (DE); Peter Schmitz, Selfkant (DE)

(73) Assignee: A. Monforts Textilmaschinen GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/540,722

(22) PCT Filed: Jul. 2, 2004

(86) PCT No.: PCT/DE2004/001407

§ 371 (c)(1),
(2), (4) Date: Jun. 24, 2005

(87) PCT Pub. No.: WO2005/005706

PCT Pub. Date: Jan. 20, 2005

(65) Prior Publication Data

US 2006/0070216 A1 Apr. 6, 2006

(30) Foreign Application Priority Data

Jul. 4, 2003 (DE) ..... 103 30 338

(51) Int. Cl.
*D06C 21/00* (2006.01)

(52) U.S. Cl. ..... 26/18.6; 26/18.5

(58) Field of Classification Search ..... 26/18.6, 26/18.5; 28/165, 156, 116, 138, 142, 139; 162/358.3, 275, 358.1, 361, 205–207, 202, 162/203; 264/282, 283; 38/11
See application file for complete search history.

(56) References Cited

U.S. PATENT DOCUMENTS

| | | | | |
|---|---|---|---|---|
| 2,721,370 A | | 10/1955 | Cluett et al. | |
| 2,870,038 A | * | 1/1959 | MacIntyre | 427/359 |
| 2,885,763 A | | 5/1959 | Schreiner | |
| 3,055,496 A | * | 9/1962 | Dunlap | 28/103 |
| 3,940,833 A | | 3/1976 | Troope | |
| 4,088,731 A | * | 5/1978 | Groome | 26/18.6 |
| 4,969,243 A | * | 11/1990 | Strahm | 26/18.6 |
| 5,791,029 A | * | 8/1998 | Maker | 26/18.6 |
| 6,279,211 B1 | * | 8/2001 | Dischler | 26/18.6 |

FOREIGN PATENT DOCUMENTS

| | | |
|---|---|---|
| DE | AS 10 72 220 | 3/1956 |
| EP | 0 097 957 A | 1/1984 |

* cited by examiner

*Primary Examiner*—Amy B. Vanatta
(74) *Attorney, Agent, or Firm*—Collard & Roe, P.C.

(57) ABSTRACT

The invention relates to a method for compressive shrinking a textile web of material (9) with the aid of a rubber blanket shrinking system, wherein the rubber blanket (3) is cooled after the main cylinder is discharged. The areas (22) of the rub blanket not covered by the web of material (9) on the main cylinder are cooled after the cylinder is removed in a faster manner than the areas (27) of the rubber blanket (3) which are covered for the fixing purposes, in order to reduce premature embrittling of the edge areas (22) of the rubber blanket (3) which is not covered by the respectively treated web of material (9) on the main cy

15 Claims, 4 Drawing Sheets

Figure 1:
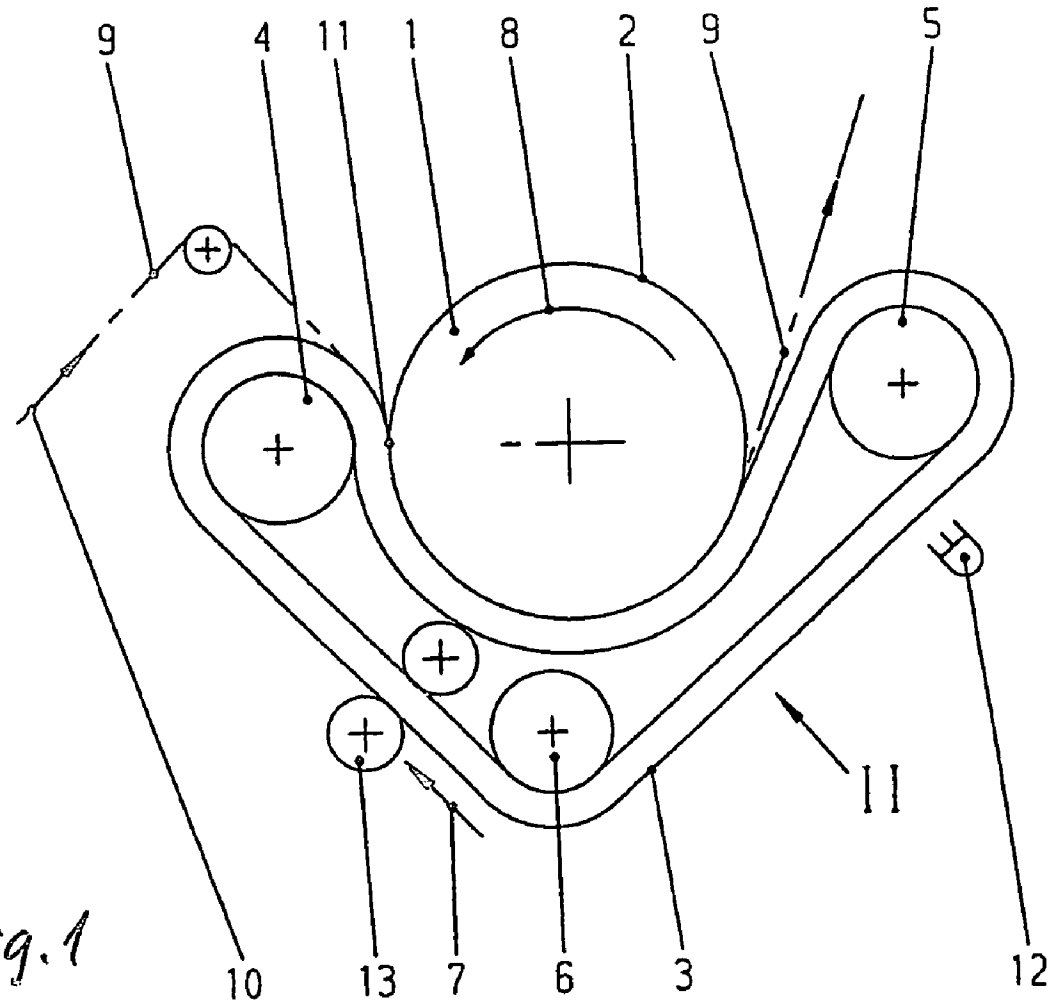

5
7
36
37a
38a
W1
37b
38b
W2
37c
38c
W3
37d
38d
W4
37e
38
38e
W5

METHOD FOR COMPRESSIVE SHRINKING AND RUBBER BLANKET SHRINKING SYSTEM

CROSS REFERENCE TO RELATED APPLICATIONS

Applicants claim priority under 35 U.S.C. §119 of German Application No. 103 30 338.3 filed on Jul. 4, 2003. Applicants also claim priority under 35 U.S.C. §365 of PCT/DE2004/001407 filed on Jul. 2, 2004. The international application under PCT article 21(2) was not published in English.

The invention relates to a method for compressive shrinking of a textile fabric web, using a compressive or rubber blanket shrinking system, in which a mechanically compressed fabric web is fixed between an endless rubber blanket and the mantle surface of a heated main cylinder or heating cylinder, and in which the region of the rubber blanket that runs off from the main cylinder, in each instance, is cooled. It furthermore relates to a rubber blanket shrinking system in which a mechanically compressed fabric web is to be fixed between an endless rubber blanket and the mantle surface of a heated main cylinder, and in which cooling means are assigned to the region of the rubber blanket that runs off the main cylinder, in each instance. The rubber blanket is also referred to as a rubber belt or rubber back cloth.

Rubber blanket shrinking systems having a so-called rubber calander are described in DE-AS 10 72 220. The main cylinder of a compressive shrinking cylinder is heated to approximately 130° C. Celsius for shrinking cotton goods, in order to fix the mechanical compression of the fabric web, in each instance. The heat provided by the main cylinder not only heats the fabric web itself, but also the rubber blanket pressing the fabric web against the main cylinder. Since the width of the fabric web varies, at least from one batch to another, the rubber blanket will generally be wider than the fabric web being treated.

Because of the heat effect of the main cylinder, the rubber blanket is heated to such an extent that plasticizers present in the rubber blanket migrate out. In order to slow down this effect, the rubber blanket in conventional shrinking systems is cooled with water over its entire width, after it runs off from the main cylinder and the fixed goods, i.e. fabric web has/have been lifted off (cf. the reference DE-AS 10 72 220, as indicated above, for example).

As they run off on the main cylinder, the (center) regions covered by the fabric web are heated less than the regions of the rubber blanket that are not touched by the fabric web, in each instance. The inventors have recognized that conventional cooling at the edge regions of the rubber blanket is not always sufficient, so that these edge regions become brittle prematurely. However, it is not possible to cool the rubber blanket more greatly in order to overcome this problem, because if the rubber blanket is too cold, proper fixation of the mechanical compression of the fabric web will not take place. In practice, it therefore had to be accepted that the rubber blanket becomes brittle due to heating of its surface, and has to be re-ground relatively frequently, approximately every two weeks if used in continuous operation. During each grinding process, the rubber blanket, which originally has a thickness of 5–8 cm, becomes thinner, and the shrinkage potential of the blanket decreases with its thickness.

The invention is based on the task of counteracting the premature wear of the regions of the rubber blanket not covered by the fabric web, in each instance, in the rubber blanket calander of a compressive shrinking system, without impermissibly cooling the active regions of the rubber blanket, i.e. the regions of the rubber blanket covered by the fabric web during operation on the main cylinder. In other words: Means are sought after to prevent the edge regions of the rubber blanket that lie outside the width of the fabric web from becoming brittle prematurely.

The solution according to the invention is indicated, for the method stated initially, in the characterizing part of claim 1. It consists, in particular, in the fact that when using a fabric web that does not completely cover the rubber blanket, the regions of the rubber blanket that are not covered by the fabric web on the main cylinder (in other words the regions that are inactive with regard to shrinking) are cooled to a greater extent after lifting off from the main cylinder than is permissible in the sense of the fixation success in the regions of the rubber blanket that are covered by the fabric web, i.e. active regions. For the rubber blanket shrinking system indicated initially, the solution consists in assigning an additional cooling device that is adaptable to the width of the edge regions to the edge regions of the rubber blanket that are not touched by the fabric web on the main cylinder. Some improvements and further embodiments of the invention are indicated in the dependent claims.

According to the invention, the inactive regions of the rubber belt that are not touched by the fabric web on the main cylinder, in other words particularly the regions at the longitudinal edges of the fabric web, are supposed to be cooled separately, specifically to a greater extent than would be permissible in the active regions of the rubber blanket, with which the fabric web is directly pressed against the main cylinder. "Greater" cooling in the sense of the invention means cooling to temperatures that are clearly below the permissible minimum temperature for the active region, on the order of 5 to 20° Celsius, in such a manner that the amount of heat transferred to the rubber blanket as it runs around the main cylinder is entirely removed again at the additional cooling device (in short: cooling unit). In this regard, the invention is based, among other things, on the recognition that a rubber blanket that has been heated up can only be cooled slowly, because of the poor heat conductivity of rubber.

The invention is therefore supposed to prevent the inactive regions from heating up at all, from one pass to the next. A penetration of the heat energy applied at the main cylinder (and removed again at the cooling unit), into the interior of the rubber blanket, is supposed to be avoided. The heat exchange between main cylinder and rubber blanket, on the one hand, and between rubber blanket and cooling unit, on the other hand, is supposed to relate only to a thin outer layer of the rubber blanket, e.g. on the order of a thickness of 2 mm. This, too, is achieved by means of the relatively strong cooling of the edge regions according to the invention.

In the invention, the poor heat conductivity of the rubber blanket is taken into consideration, i.e. utilized. The heat applied on the outside of such a blanket penetrates only slowly into the depth of the blanket. The same applies for the effect of rubber blanket cooling, the cooling effect also progresses slowly into the depth of the rubber blanket. According to a calculated example, it takes about two seconds until a layer that lies about 1 cm beneath the heated rubber blanket surface has cooled from 120 to 40° Celsius. Since rubber blankets run at a production speed on the order of 50 m/min (0.833 m/s), approximately 1.5 m of the rubber blanket would be needed for cooling. However, such a cooling length is not available in a compressive shrinking system. Therefore, without using the invention, the heat applied at the main cylinder penetrates deeper into the edge regions from one pass to the next, and the remaining temperature of the inactive edge regions rises to an equilibrium value that is disadvantageous for the useful lifetime of the rubber.

The invention counters this problem in that the inactive edge regions are cooled so intensively, right from the start (essentially starting with the first pass), that the amount of heat previously applied during the same pass is practically completely removed again. This means that the heat energy does not have any opportunity of penetrating deep into the material of the rubber blanket, at least not in a non-permissible temperature range, and accordingly only a relatively thin outer layer is alternately heated and cooled. If this heated and cooled outer layer has a thickness of 2 mm, for example, it can be cooled from 120° to 40° Celsius in on the order of 0.3 seconds (in the aforementioned arithmetical example); at the speed of 50 m/min indicated above, only approximately 25 cm are then required for cooling; cooling paths of this length can easily be handled in conventional rubber blanket shrinking systems, in terms of their design.

The cooling of the inactive edge regions of the rubber blanket preferably starts immediately after the machine has been put into operation. Preferably, in this context, the cooling output per pass should be made approximately equal to the heating output per pass.

According to a further invention, the edge regions of the rubber blanket as defined above each have a(n) (additional) cooling device that can be adapted to the width of the edge regions, in each instance, assigned to them. For example air jets or water jets can be directed at the inactive regions of the rubber blanket from nozzles. To generate the jets, pivoting nozzle bars that carry the nozzles in question can be provided. The width of the edge regions to be cooled, which depends on the width of the fabric web being treated, can be controlled by a sensor that scans the fabric web edge, in each instance. Flat-jet spray nozzles can be adapted particularly well to the measured width of the (inactive) edge region to be cooled, in each instance. Flat-jet spray nozzles whose spraying region is elongated almost in a line on the surface being treated can be switched in stages, as a function of the edge width to be cooled. They also permit a continuous adaptation to the width of the edge strip to be cooled, among other things by means of rotation of the spray region (about an axis essentially perpendicular to the rubber blanket cover), if the flat jet and therefore its spray region are rotated in accordance with the edge width, or if the distance between jets is varied.

As an alternative to a single pivoting nozzle bar, several stationary nozzle bars can also be provided for an adaptation to the width. The single nozzle bar can be assigned to a total width of the edge region that has been determined, in each instance, and can be separately controlled, for example by means of a valve. The nozzle bars can be equipped with flat-jet nozzles. When using these nozzles, it is possible to orient the spray region of the flat jet against the running direction of the rubber blanket, at a predetermined angle. The number of stationary nozzle bars required in each instance is based on the maximal size of the inactive region of the rubber blanket to be spray (to be cooled), in each instance, in other words on the ratio of the minimal material web width to the rubber blanket width.

The aforementioned spray angle, with which the spray region of the flat jet is inclined relative to the edge of the rubber blanket, is supposed to be adjusted separately for every nozzle bar, in other words with a different orientation. In a preferred exemplary embodiment, the angle at which the spray region of the flat-jet nozzles is inclined relative to the rubber blanket edge is made relatively small in a first nozzle bar that is assigned to an inactive region of the rubber blanket having a width of 100 mm, for example. At a second nozzle bar, which is provided towards the center of the rubber blanket, whose nozzles are supposed to cover a broader edge region, for example one having a width of 200 mm, the angle is selected to be greater, namely so great that the spray region that is straight, in a line shape, extends (at a slant) from one lengthwise edge of the edge region to the other. In order to obtain the same spray intensity per area unit in the lengthwise direction as with the first nozzle bar, despite this, two flat-jet nozzles (that are oriented the same way) can be provided on the second bar. Accordingly, both the angle of the flat jet (measured relative to the blanket edge) and the number of nozzles can be selected to be increasingly greater on each additional nozzle bar that lies further inward. If necessary, the same spray distance and the same intensity are achieved for every spray region.

The maximal edge width to be cooled in this manner is predetermined by the length of the flat-jet spray region. The length can be adapted to the edge width by changing the distance between nozzle and rubber blanket. However, if a particularly narrow fabric web is being treated on a particularly wide machine (with a corresponding wide rubber blanket), without damaging the rubber blanket, two or more nozzle bar groups of the aforementioned type can be provided at the edges of the rubber blanket, at intervals of the length of a spray region.

As stated, water or air (or, in general, liquid or gases) can be provided as the cooling agent. The advantage of air cooling consists in the better ability to meter it, the advantage of water cooling consists in the better effectiveness; however, the water sprayed onto the rubber blanket must be squeezed off before the blanket again runs into the region in which it is supposed to exert the compressive shrinkage.

The cooling agents assigned to the inactive edge regions, e.g. nozzles, can have a separately controlled, i.e. independent cooling agent supply system in accordance with the type of a counter-current principle. If necessary, the same cooling agent, e.g. fresh water, can first be used to cool the edge regions being treated, in each instance. The return water that occurs there is re-circulated with a pump and used for pre-cooling of the same edge region. In this connection, it is also possible to proceed in three or more stages—the re-circulated water that runs off from a cooled region is used to cool a preceding edge region, in the running direction of the rubber blanket, which is even warmer.

Figure 2:
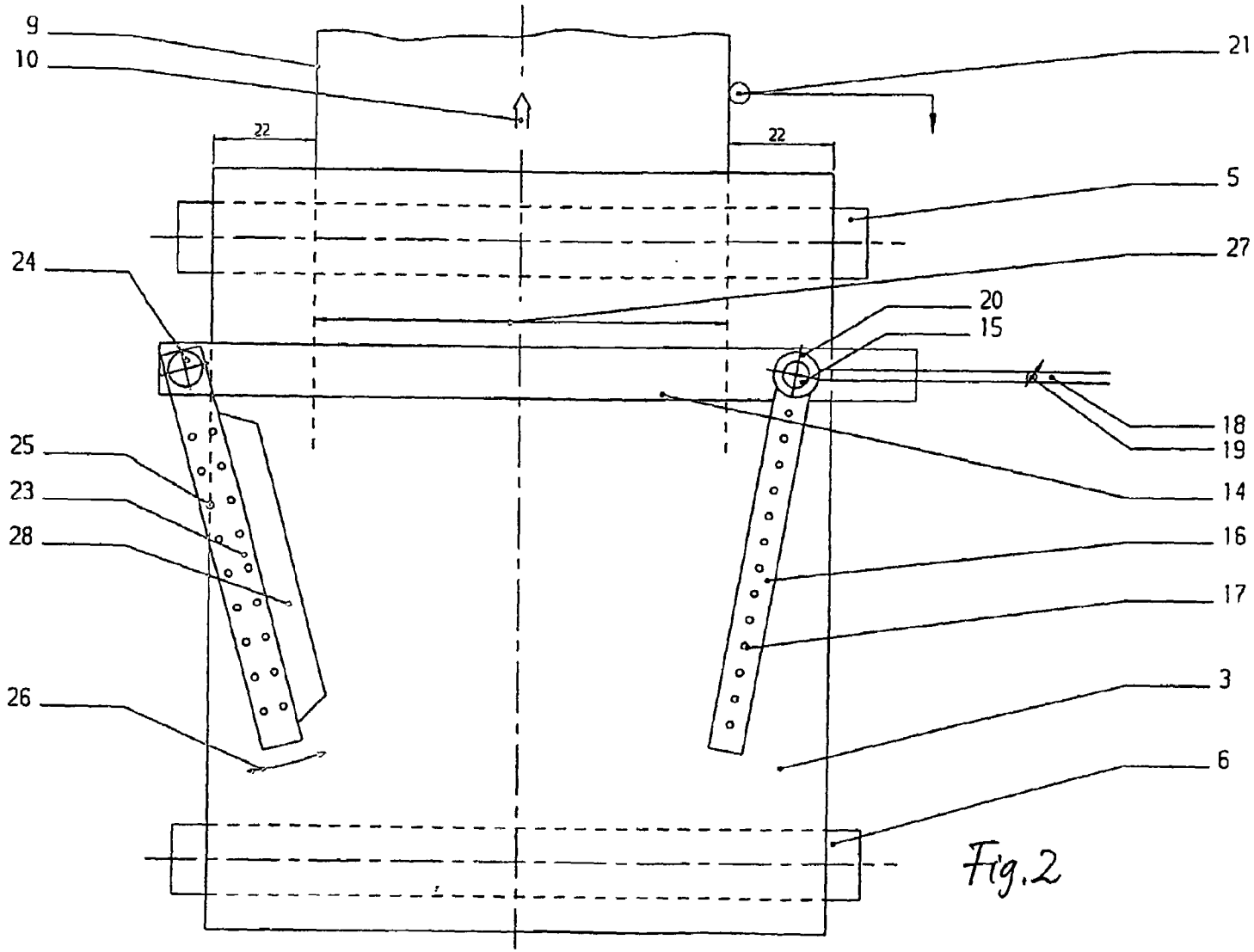
Figure 3:
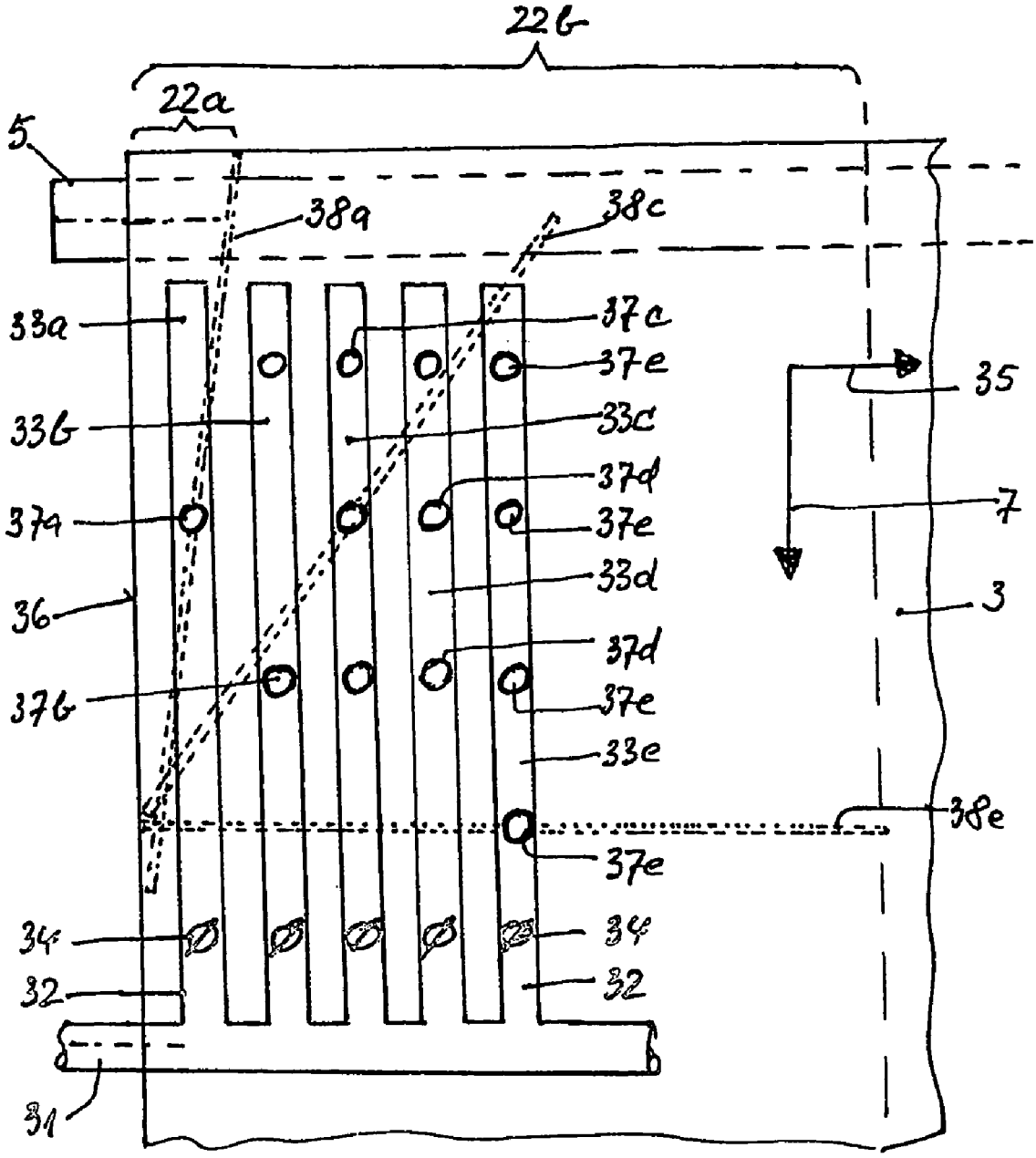
Figure 4:
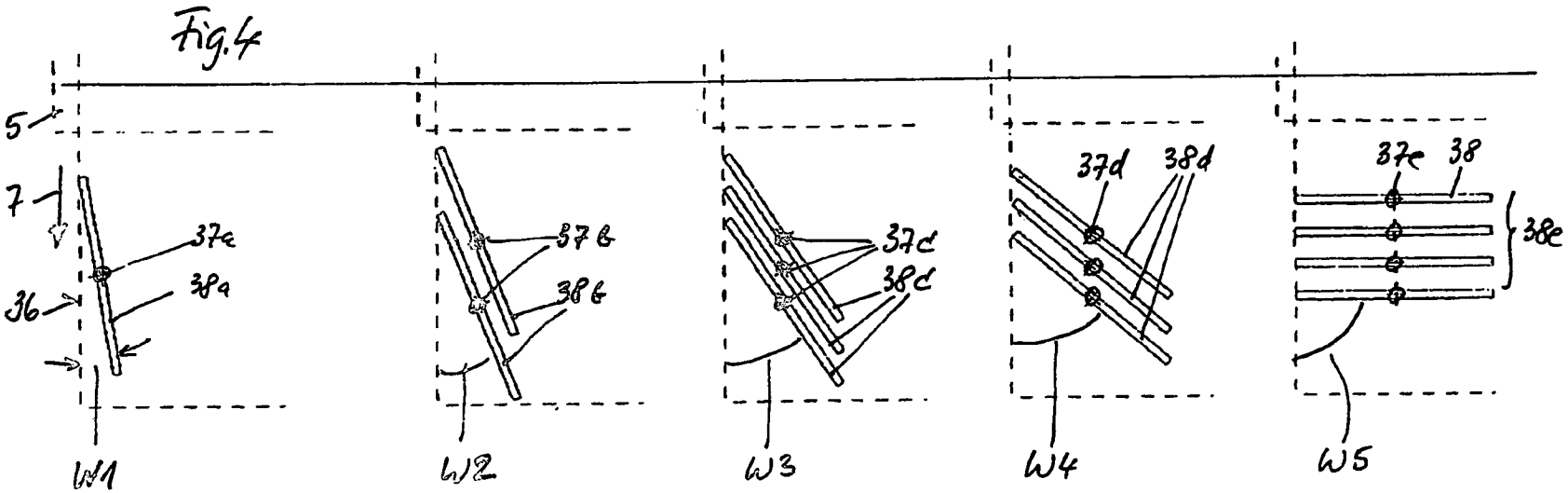

Details of the invention will be explained using the schematic representation of exemplary embodiments. The drawing shows:

FIG. 1 a fundamental representation of a rubber blanket shrinking system, in perpendicular longitudinal cross-section;

FIG. 2 a top view of the cooling region of the rubber blanket, with movable cooling devices; and FIGS. 3 and 4 an exemplary embodiment having stationary cooling devices.

FIG. 1 shows a rubber blanket shrinking system in longitudinal cross-section (perpendicular to the cylinder axes shown). The system fundamentally consists of a heated main cylinder 1, against the mantle surface 2 of which an endless rubber blanket 3 that is tensioned in its longitudinal direction is pressed. The latter is guided over the so-called contact pressure roller 4 as well as over guiding and deflecting rollers 5, 6, in the running direction 7 shown. The corresponding direction of rotation 8 of the main cylinder 1 is also shown with an arrow.

The fabric web 9 to be shrunk runs over the contact pressure roller 4 into the so-called shrink nip 11, where mechanical shrinking takes place, in the transport direction 10 shown.

The mechanically produced shrinkage is fixed by means of the effect of the heated main cylinder 1, while simultaneously, the fabric web 9 is pressed against the mantle surface 2 by means of the rubber blanket 3. The rubber blanket 3 possesses a predetermined initial thickness in order to achieve a noteworthy shrinking effect. If the blanket becomes brittle, it must be ground down. In order to reduce the speed at which it becomes brittle, the rubber blanket 3 is cooled, over its entire width, using a water shower 12, after it runs off from the mantle, surface 2. Cooling is only allowed to take place to such an extent that the rubber blanket 3 is still warm enough to sufficiently support the fixing process on the mantle surface 2 of the main cylinder when it subsequently arrives at the shrink nip 11 again. The liquid applied with the water shower 12 must be pressed off the rubber blanket 3 again before it arrives at the contact pressure roller 4, down to a defined residual moisture, e.g. using a pair of squeezing rollers 13.

FIG. 2 describes exemplary embodiments of additional cooling devices according to the invention, as a top view onto the rubber blanket 3, and can be viewed as a view in the direction of the arrow II of FIG. 1. Accordingly, stumps of the rollers 5 and 6 as well as the fabric web 9 that is running in the transport direction 10 (already shrunk and fixed) can be seen in FIG. 2 behind the rubber blanket 3.

FIG. 2, in the right half, shows a (water) nozzle bar 16 that can pivot about an axis 15, on a carrier 14. This bar possesses a plurality of nozzles 17 that follow one another in the longitudinal direction of the bar 16, according to the drawing, and can have a liquid feed line 18 with a symbolically shown control valve 19. Furthermore, the bar possesses a pivot drive 20 that is configured in such a manner, for example, that it controls the bar 16 in a predetermined manner, to pivot about the axis 15 that stands perpendicular to the plane of the drawing. The pivot drive can be controlled by means of a sensor 21, which (in the final analysis) determines, by scanning the fabric web edge, how wide the individual edge regions 22 of the rubber blanket 3 not covered by the fabric web 9 are. Using the measurement results of the sensor 21, the pivot drive 20 can be controlled in such a manner that the bar 16 with its nozzles 17 just cools the two edge regions 22 with water, in each instance.

The air cooling bar 23 in the left half of FIG. 2 functions, in principle, similar to the water cooling bar 16 in the right half of FIG. 2. The former bar, as well, can be mounted on the carrier 14 with its axis 24 standing perpendicular to the plane of the drawing, and can possess a pivot drive (not shown) that can be controlled by a sensor, similar to the sensor 21. The air cooling bar 23 is supposed to possess a plurality of blowing or cooling nozzles 25 that are disposed next to one another and one behind the other in the longitudinal direction of the bar 23, for example, as shown. These cooling nozzles are directed at the rubber blanket 3 in such a manner, by pivoting the bar 23, that they only cool the edge region 22, in each instance, as accurately as possible. For this purpose, the cooling bar 23 can be moved back and forth in the pivot direction 26 shown. In order to avoid undesirable cooling of the region 27 of the rubber blanket 3 that is active on the main cylinder 1, a doctor 28 can be affixed to the bar 23 (and also to the bar 16). The active region 27 of the rubber blanket 3, which is the center region of the rubber blanket in the exemplary embodiment, delimits the rubber blanket region between the two edge regions 22 that is used to press the fabric web 9 directly against the mantle surface 2 of the main cylinder 1.

FIGS. 3 and 4 show the adaptation of the cooling region to the fabric web width when using several stationary nozzle bars, whereby the situation at the left edge of the rubber blanket will be described in the following. At the right edge of the rubber blanket, spraying takes place in a mirror image. The same parts as in FIGS. 1 and 2 have the same reference numbers.

Several individual pipes 32 proceed from a collector 31 according to FIG. 3, through which the cooling agent, e.g. cooling water or cooling air, flows. The number of pipes 32 is based on the ratio of minimal fabric web width to rubber blanket width. Each of these pipes 32 is connected with a nozzle bar 33 a to e. There is a shut-off valve 34 between the pipe 32, in each instance, and the related nozzle bar 33.

According to FIG. 3, different numbers of flat-jet nozzles are screwed into nozzle bars 33*a* to *e* that follow one another in the direction 35 towards the center of the fabric web. It is assumed that each nozzle bar possesses four connection locations for screwing nozzles in. In the first bar 33*a*, viewed from the edge 36, one flat-jet nozzle 37*a* is screwed in, in a center position. In the second nozzle bar 33*b*, viewed from the edge 36, two flat-jet nozzles 37*b* are screwed in. In the third nozzle bar 33*c*, viewed from the edge, three flat-jet nozzles 37*c* are screwed in. In the representation of FIG. 3, the fourth nozzle bar 33*d* is also equipped with three flat-jet nozzles 37*d*. The fifth nozzle bar 33*e* according to FIG. 3 possesses four flat-jet nozzles 37*e*. Fundamentally, however, different numbers of nozzles can also be provided in the various nozzle bars, but also linearly increasing numbers of nozzles (first bar one nozzle, second bar two nozzles, third bar three nozzles, fourth bar five nozzles, etc.) or other spatial distributions of the nozzles can be provided.

In operation, the nozzles 33*a* to *e* produce long, narrow spray regions 38*a* to *e* on the rubber blanket 3, according to FIGS. 3 and 4. In the exemplary embodiment described, the nozzles of the various bars are oriented differently. According to FIG. 4, the spray angles w1 to w5 between flat-jet nozzle 37*a* to *e*, i.e. spray region 38*a* to *e* and edge 36 of the rubber belt are provided to be the same in each individual bar, but varying from one bar to another. According to the drawing, the nozzle 37*a* in the first nozzle bar 33*a* is oriented, i.e. screwed in, in such a manner that the angle w1 between the edge 36 and the spray region 38*a* becomes relatively small. In this manner, a minimally narrow edge region 22*a* can be cooled. When the second nozzle bar 33*b* is activated, the angle w2 between spray region 38*b* and edge 36 of the rubber blanket 3 becomes greater than the angle w1, and the edge region to be cooled becomes correspondingly wider. At the third nozzle bar 33*c*, the angle w3 becomes even greater, etc. When the nozzle bar 33*e* is activated (along with its nozzle 37*e*), the edge region 22*b* can be cooled at the maximal width. By means of the different number of the flat-jet nozzles 37 on each of the nozzle bars 33 and the different angles w, the result is achieved that the intensity of spraying remains approximately the same even with a greater inactive edge region 22 of the rubber blanket 3 that is to be sprayed.

The stated angles w1 to w5 can be selected in such a manner, for example, that an inactive rubber belt strip of 100 mm on each side can be sprayed and cooled. If the edge region is wider, e.g. 200 mm wide, the second nozzle bar 33*b* is turned on, and the first nozzle bar 33*a* is shut off. If the edge regions are even broader, the next nozzle bars 33*c* to *e* are optionally activated. Within the scope of the invention, however, individual nozzle bars 33 can also be used at the same time to cool the inactive edge region, in each instance.

REFERENCE SYMBOL LIST

1=main cylinder
2=mantle surface
3=rubber blanket
4=contact pressure roller
5=guide roller
6=deflection roller
7=running direction
8=direction of rotation
9=fabric web
10=transport direction
11=shrink nip
12=water shower
13=pair of squeezing rollers
14=carrier
15=axis
16=nozzle bar
17=water nozzles
18=water line
19=valve
20=pivot drive
21=sensor
22=edge region
23=nozzle bar
24=axis
25=nozzles
26=pivot direction
27=active region
28=doctor
31=collector
32=individual pipe
33=nozzle bar
34=shut-off valve
35=direction towards center of blanket
36=rubber blanket edge
37=flat-jet nozzle
38=spray region
w1–w5=spray angles

The invention claimed is:

1. A method for compressive shrinking of a textile fabric web using a rubber blanket shrinking system comprising the steps of:

(a) disposing a mechanically compressed fabric web between an endless rubber blanket and a mantle surface of a heated main cylinder to form active regions of the rubber blanket covered by the fabric web on the main cylinder and inactive regions of the rubber blanket not covered by the fabric web on the main cylinder; and (b) cooling an area of the rubber blanket at a location where the area is not in contact with the main cylinder;

wherein the inactive regions are cooled separately and to a greater extent after leaving the main cylinder than the active regions.

2. The method according to claim 1, wherein the inactive regions are cooled by temperatures on the order of 5 to 20° Celsius more than the active region of the rubber blanket that is covered by the fabric web on the main cylinder.

3. The method according to claim 1, wherein the amount of heat supplied to the inactive regions during a pass of the rubber blanket on the main cylinder is essentially completely removed again during the same pass.

4. The method according to claim 1, wherein the separate cooling of the inactive edge regions takes place starting with a first pass of the rubber blanket on the main cylinder.

5. The method according to claim 1, wherein the inactive regions are cooled in stages according to a type of counter-flow principle.

6. A rubber blanket shrinking system comprising:

(a) an endless rubber blanket;

(b) a heated main cylinder having a mantle surface, wherein a mechanically compressed fabric web is to be disposed between the endless rubber blanket and the mantle surface of the main cylinder to form active regions of the rubber blanket covered by the fabric web on the main cylinder and inactive edge regions of the rubber blanket not covered by the fabric on the main cylinder having a selected width;

(c) a first cooling device for dispensing a first cooling agent to an area of the rubber blanket at a location where the area is not in contact with the main cylinder; and (d) a second cooling device for dispensing a second cooling agent to the inactive edge regions after leaving the main cylinder, the second cooling device being adapted to the width of the inactive edge regions.

7. The rubber blanket shrinking system according to claim 6, wherein the second cooling device comprises means for spraying on cooling water jets or air jets onto the inactive edge regions.

8. The rubber blanket shrinking system according to claim 6, wherein the second cooling device comprises pivoting cooling bars.

9. The rubber blanket shrinking system according to claim 6, further comprising at least one sensor for controlling the width of the rubber blanket region cooled by the second cooling device.

10. The rubber blanket shrinking system according to claim 6, further comprising flat-jet spray nozzles having a jet that can pivot about the longitudinal jet axis, for applying the first cooling agent.

11. The rubber blanket shrinking system according to claim 6, wherein the second cooling device comprises stationary nozzle bars, wherein at least one nozzle bar is arranged to dispense the second cooling agent to a respective portion of the inactive edge region.

12. The rubber blanket shrinking system according to claim 11, wherein nozzle bars are disposed parallel to one another and follow one another in the direction towards the center of the rubber blanket.

13. The rubber shrinking system according to claim 11, wherein each nozzle bar has a respective number of flat-jet nozzles having a respective spray angle, the number being at least one and being different for each nozzle bar, and the spray angle being different for each nozzle bar.

14. The rubber blanket shrinking system according to claim 11, wherein the nozzle bars have an increasing number of flat-jet nozzles from the edge in the direction towards the center of the rubber blanket, and the spray region of the nozzle bars produced by the nozzles is oriented to be flatter from the blanket edge towards the center.

15. The rubber blanket shrinking system according to claim 11, wherein each nozzle bar is connected with a collector by way of a shut-off valve, and the nozzle bars can be controlled with the same nozzle equipment, in pairs on the right and the left.

* * * * *

UNITED STATES PATENT AND TRADEMARK OFFICE

CERTIFICATE OF CORRECTION

PATENT NO. : 7,171,732 B2
APPLICATION NO. : 10/540722
DATED : February 6, 2007
INVENTOR(S) : Klas et al.

It is certified that error appears in the above-identified patent and that said Letters Patent is hereby corrected as shown below:

Column 8, line 46 (Line 2 of Claim 12) after the word "wherein" please insert the word: --the--.

Signed and Sealed this

Twelfth Day of June, 2007

JON W. DUDAS
*Director of the United States Patent and Trademark Office*